US009673035B2

(12) United States Patent
Park et al.

(10) Patent No.: US 9,673,035 B2
(45) Date of Patent: Jun. 6, 2017

(54) ION SOURCE, AND MASS ANALYSIS APPARATUS INCLUDING SAME

(71) Applicant: KOREA RESEARCH INSTITUTE OF STANDARDS AND SCIENCE, Daejeon (KR)

(72) Inventors: Chang Joon Park, Daejeon (KR); Jong Rok Ahn, Daejeon (KR); Cheolsu Han, Suwon-si (KR); Sang Jung Ahn, Daejeon (KR)

(73) Assignee: Korea Research Insitute of Standards and Science, Daejeon (KR)

( * ) Notice: Subject to any disclaimer, the term of this patent is extended or adjusted under 35 U.S.C. 154(b) by 24 days.

(21) Appl. No.: 14/442,283

(22) PCT Filed: Aug. 20, 2013

(86) PCT No.: PCT/KR2013/007445

§ 371 (c)(1),
(2) Date: May 12, 2015

(87) PCT Pub. No.: WO2014/073778

PCT Pub. Date: May 15, 2014

(65) Prior Publication Data

US 2016/0225600 A1 Aug. 4, 2016

(30) Foreign Application Priority Data

Nov. 12, 2012 (KR) ..... 10-2012-0127690

(51) Int. Cl.
*H01J 49/14* (2006.01)
*H01J 49/06* (2006.01)
*H01J 49/16* (2006.01)

(52) U.S. Cl.
CPC ..... *H01J 49/147* (2013.01); *H01J 49/067* (2013.01); *H01J 49/16* (2013.01)

(58) Field of Classification Search
CPC combination set(s) only.
See application file for complete search history.

(56) References Cited

U.S. PATENT DOCUMENTS 6,686,595 B2 * 2/2004 Horsky ..... H01J 27/20 250/423 R
7,041,984 B2 5/2006 Ellefson et al.
(Continued)

FOREIGN PATENT DOCUMENTS

JP 2003270207 A 9/2003
JP WO 2007102204 A1 * 9/2007 ..... G01N 27/62
(Continued)

OTHER PUBLICATIONS

International Search Report PCT/ISA/210 for International Application No. PCT/KR2013/007445 Dated Dec. 6, 2013.
(Continued)

*Primary Examiner* — Phillip A Johnston
*Assistant Examiner* — Hsien Tsai
(74) *Attorney, Agent, or Firm* — Harness, Dickey & Pierce, P.L.C.

(57) ABSTRACT

According to one embodiment of the present invention, an ion source includes: an anode tube in which gas flowing in through one side is ionized and discharged to the other side and in which a slit is formed on the outer circumference thereof; a filament which emits thermal electrons toward the slit so as to ionize the gas; and a diffusion-preventing body arranged between the filament and the slit and having at least one hole through which the thermal electrons can pass so as to reduce the diffusion of the thermal electrons flowing into the anode tube.

7 Claims, 9 Drawing Sheets

(56) References Cited

U.S. PATENT DOCUMENTS

| | | | | |
|---|---|---|---|---|
| 7,605,379 | B2 | 10/2009 | Xiao et al. | |
| 2005/0258374 | A1* | 11/2005 | Ellefson | H01J 49/10 250/427 |
| 2008/0277592 | A1 | 11/2008 | Xiao et al. | |
| 2010/0028613 | A1* | 2/2010 | Schmidt | B82Y 30/00 428/172 |

FOREIGN PATENT DOCUMENTS

| | | | |
|---|---|---|---|
| KR | 20110036379 | A | 4/2011 |
| KR | 1020110036379 | * | 7/2011 |
| WO | WO-2007102204 | A1 | 9/2007 |

OTHER PUBLICATIONS

Written Opinion of the International Searching Authority PCT/ISA/237 for International Application No. PCT/KR2013/007445 dated Dec. 6, 2013.

* cited by examiner

ION SOURCE, AND MASS ANALYSIS APPARATUS INCLUDING SAME

TECHNICAL FIELD

The present invention relates to an ion source for ionizing gas molecules, and a mass analysis apparatus including the same.

BACKGROUND ART

A mass spectrometer is an apparatus for measuring and analyzing a mass of molecules. The mass spectrometer serves to ionize a sample material into ions, and to separate the generated ions in order of a mass to charge ratio. Such a mass spectrometer is composed of an ion source, a mass filter and a detector. The ion source serves to generate ions by ionizing sample gas to be analyzed, and the mass filter serves to filter ions generated from the ion source under a specific condition that only a specific mass of the ions can pass through. The detector serves to collect ions having passed the mass filter and to convert the ions into an electric signal. A result collected from the detector, which displays sample gas information, is provided to a user as an x (mass)-y (signal) plot. A mass peak can be identified using a library search program.

For an accurate identification of the sample gas, signal intensity should be high enough, and the mass filter should have a very narrow pass band. The sensitivity and mass resolution are the important factors for evaluation of the mass spectrometer performance.

In a mass spectrometer such as a gas chromatograph mass spectrometer or a residual gas analyzer, an ion source is a core component which greatly influences on sensitivity and resolution of the mass spectrometer. Accordingly, an ion source with improved ionization efficiency may be considered for higher sensitivity of the mass spectrometer.

Among the various mass spectrometers, a residual gas analyzer is widely used in the fields such as semiconductor devices, flat panel displays, industries related to vacuum and aerospace, etc.

DISCLOSURE OF THE INVENTION

Therefore, an object of the present invention is to provide an ion source which, with improved ionization efficiency, enables more ions to reach the detector after passing through the mass filter, and thereby enhances sensitivity of the mass spectrometer.

To achieve these and other advantages and in accordance with the purpose of the present invention, as embodied and broadly described herein, there is provided an ion source, including: an anode tube configured to ionize gas introduced through one side and to discharge the ionized gas to the other side, and having a slit formed on a circumference thereof; a filament configured to emit thermal electrons toward the slit so as to ionize the gas; and a diffusion-preventing body arranged between the filament and the slit and having at least one hole through which the thermal electrons pass into the anode tube.

In an embodiment of the present invention, the diffusion-preventing body may be formed of a conductive material, may be formed to have a mesh shape, and may be coupled to an outer circumference of the anode tube.

In an embodiment of the present invention, the filament may be formed to have a circular arc shape, and a first electrode and a second electrode may be connected to the two ends of the filament. A common electrode may be connected to one point between the first and second electrodes.

In an embodiment of the present invention, the slit may be positioned to face the filament formed between the first electrode and the common electrode, or the slit may be positioned to face the filament formed between the second electrode and the common electrode.

In an embodiment of the present invention, the slit may be formed on an outer circumference of the anode tube in plurality in number.

In an embodiment of the present invention, the ion source may further include a repeller formed at a position spaced from an outer circumference of the filament so that thermal electrons from the filament are emitted toward the slit.

In an embodiment of the present invention, the ion source may further include a focus lens formed at another side of the anode tube so as to focus gas ions coming from the anode tube.

To achieve these and other advantages and in accordance with the purpose of the present invention, as embodied and broadly described herein, there is also provided a mass analysis apparatus, including: the ion source configured to ionize gas introduced thereinto through one side and to discharge the ionized gas to the other side; a mass filter unit configured to filter only a specific mass among gas ions discharged from the ion source; and a detector configured to detect the filtered ions.

The ion source and the mass spectrometer including the same according to at least one embodiment of the present invention have the following advantages. Owing to the conductive diffusion-preventing body formed on a slit, a voltage inside the anode tube can be distributed uniformly, so that diffusion of electrons passing through the slit can be prevented, and discharge of sample gas to outside through the slit can be reduced. This can increase ionization efficiency and thus enhance sensitivity of the mass spectrometer.

MODES FOR CARRYING OUT THE PREFERRED EMBODIMENTS

Description will now be given in detail of an ion source and a mass analysis apparatus including the same according to the present invention, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function.

A singular representation may include a plural representation unless it represents a definitely different meaning from the context.

Figure 1:
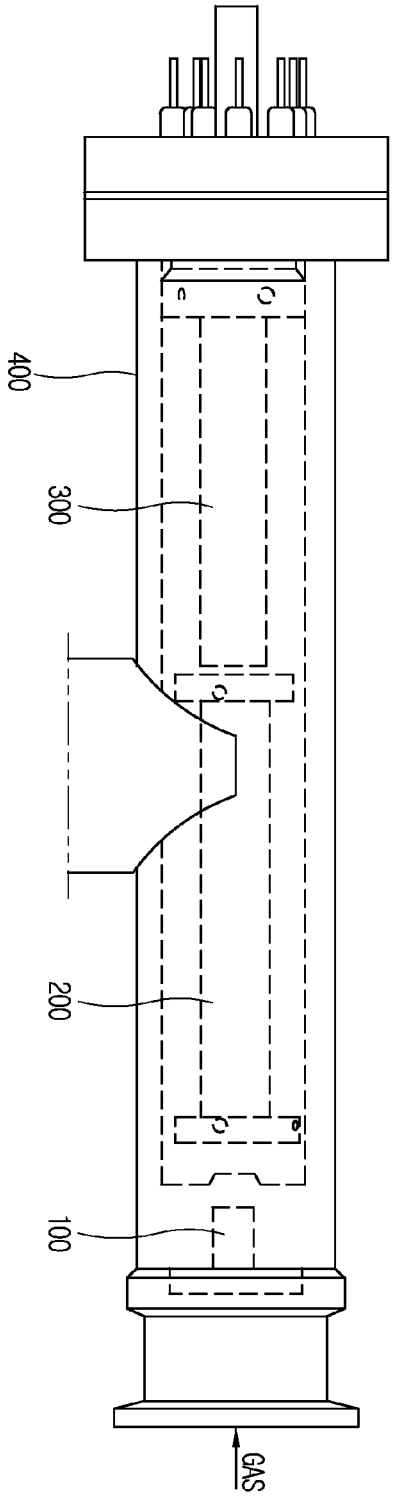
FIG. 1 is a conceptual view illustrating a residual gas analysis apparatus as an example of a mass spectrometer according to an embodiment of the present invention.

FIG. 1 is a conceptual view illustrating a residual gas analysis apparatus as an example of a mass spectrometer according to an embodiment of the present invention.

The residual gas analysis apparatus may include an ion source 100, a filter unit 200 and a detector 300. The ion source 100, the filter unit 200 and the detector 300 may be mounted in a vacuum chamber 400.

The ion source 100 may be configured to have a hollow cylindrical body partially, and may be formed to discharge gas flowing in through one side to the other side after ionization.

Figure 3:
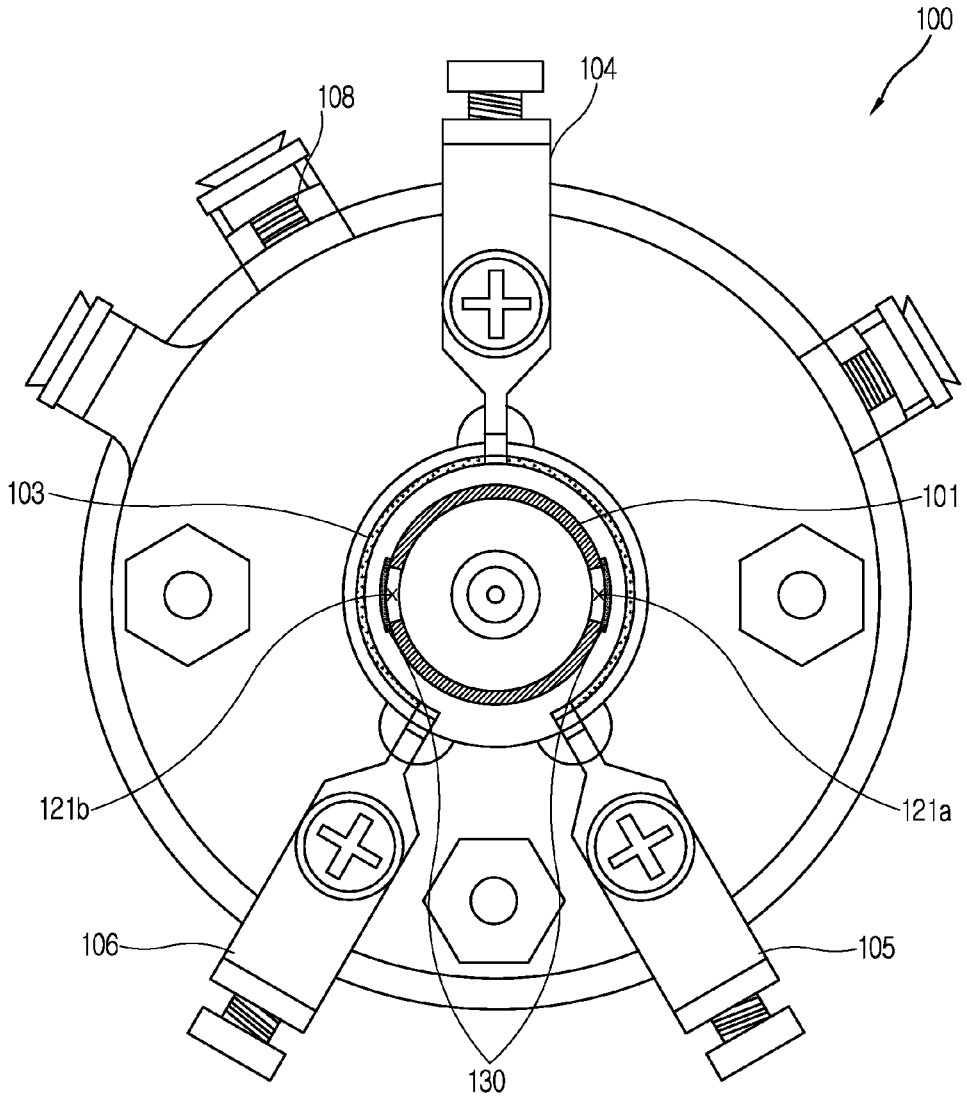
FIG. 3 is a planar view of FIG. 2.

As the ion source 100, may be used an electron-impact ion source which is ionized by colliding with neutral molecules or atoms, by accelerating thermal electrons generated when an electric current flows on a filament 103 (refer to FIG. 3). The ion source 100 may be categorized into an open ion source (OIS) and a closed ion source (CIS). The present invention relates to a closed ion source (CIS) used to measure gases in a vacuum chamber which is at a relatively high pressure of $10^{-4}$~$10^{-2}$ Torr, or used to measure impurity gases of a process chamber.

Hereinafter, the ion source 100 according to a preferred embodiment of the present invention will be explained in more detail with reference to the attached drawings.

Figure 2:
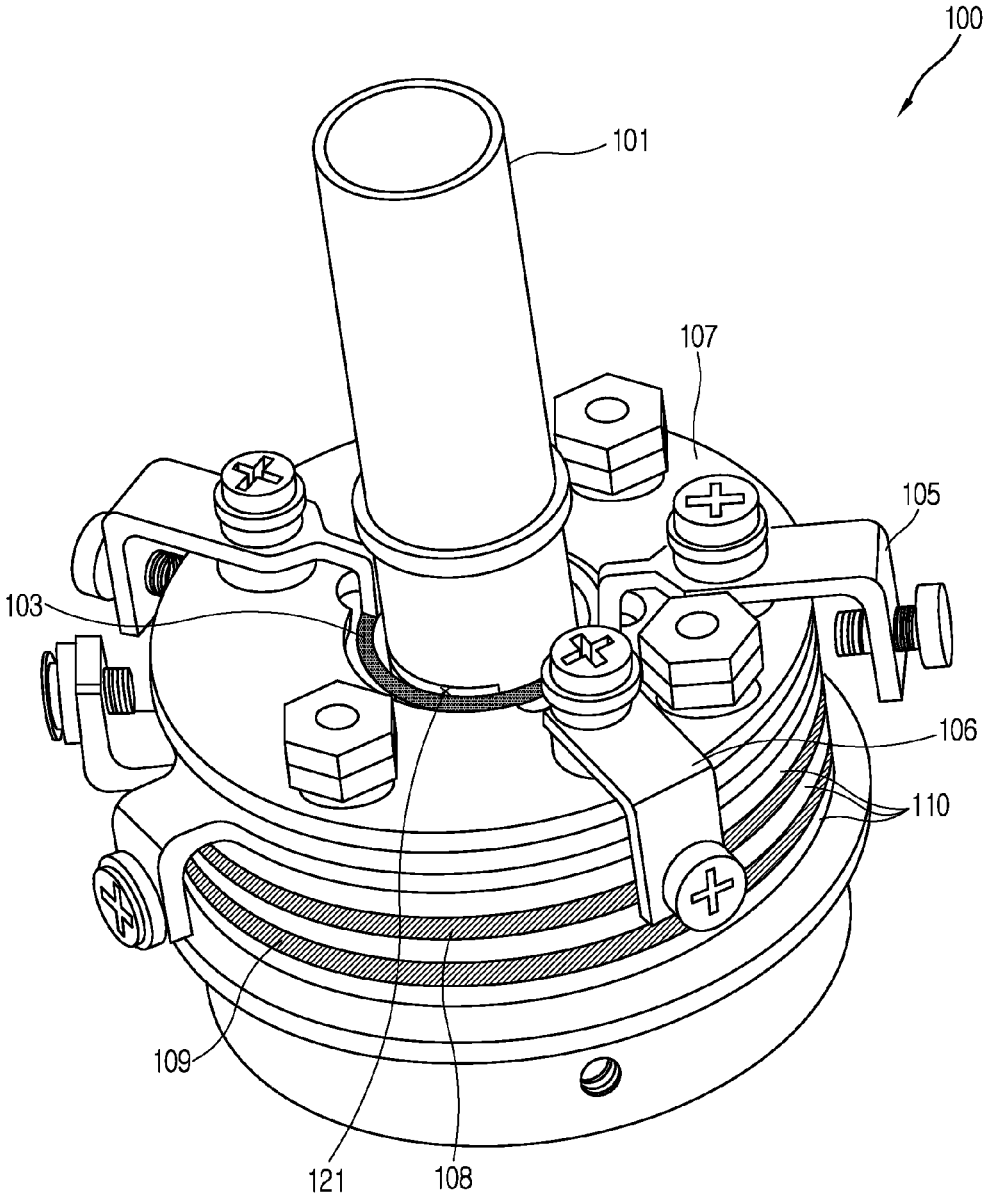
FIG. 2 is a perspective view of an ion source according to an embodiment of the present invention.
Figure 4:
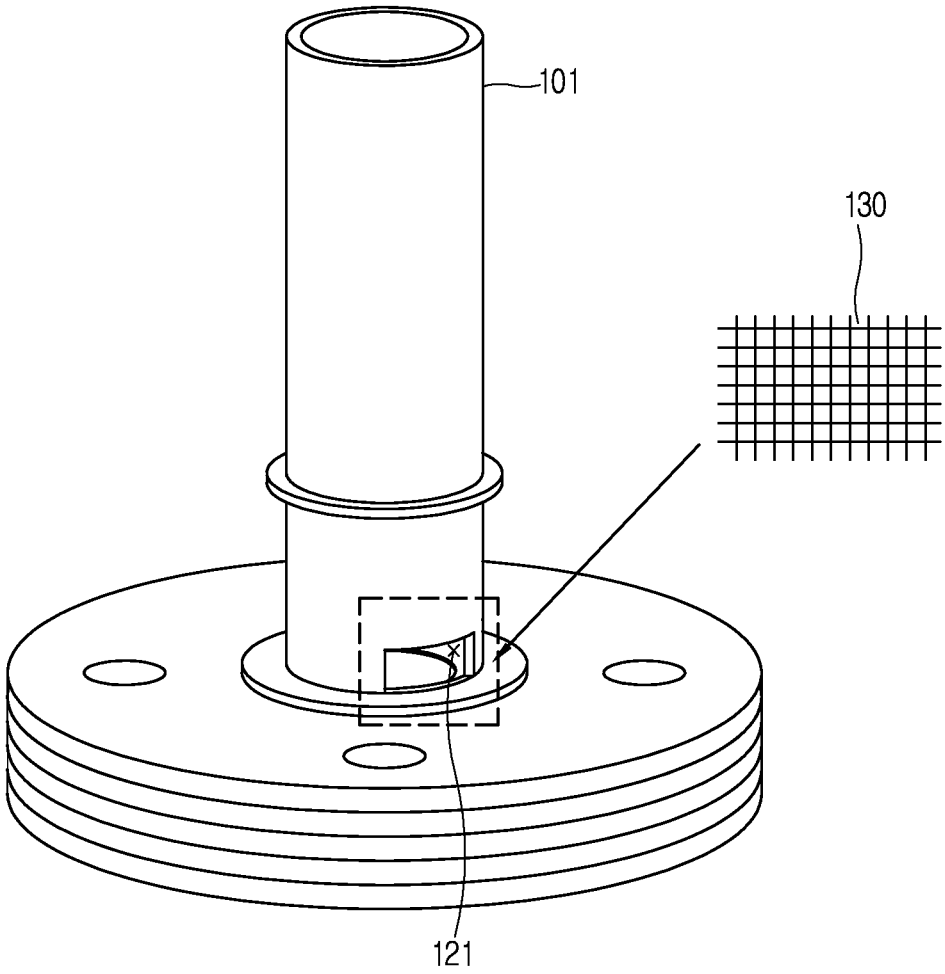
FIG. 4 is a conceptual view illustrating an example of a diffusion-preventing body coupled to an anode tube.
Figure 5:
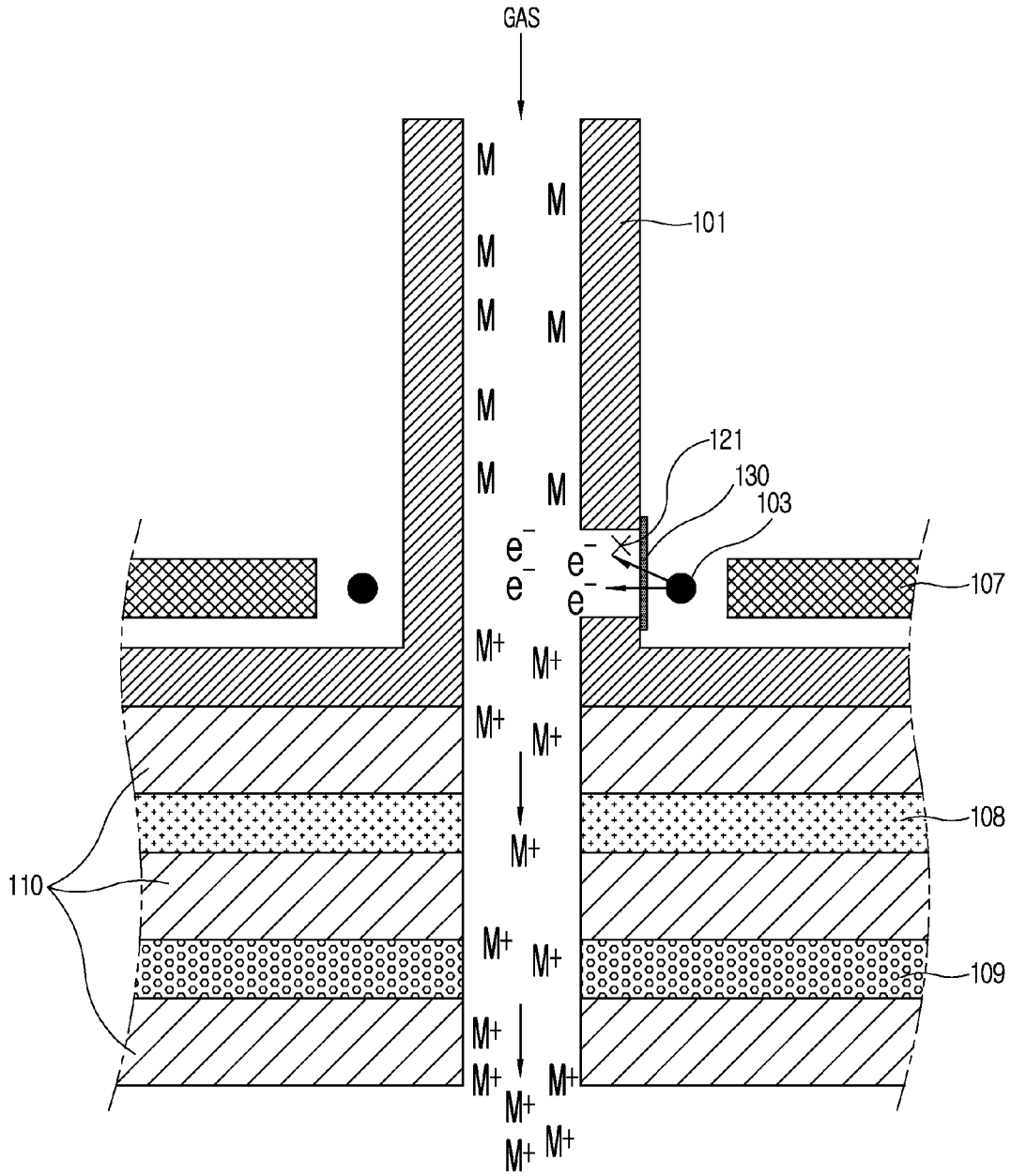
FIG. 5 is a sectional view of FIG. 2.

FIG. 2 is a perspective view of the ion source 100 according to an embodiment of the present invention, FIG. 3 is a planar view of FIG. 2, FIG. 4 is a conceptual view illustrating an example of a diffusion preventing body coupled to an anode tube 101, and FIG. 5 is a sectional view of FIG. 2.

Referring to FIGS. 2 to 5, the ion source 100 may include an anode tube 101, a filament 103, and a diffusion-preventing body 130 (refer to FIG. 3). The anode tube 101 may be formed as a cylindrical chamber having a slit. Gas flowing into the anode tube 101 from one side may be ionized in the anode tube 101, and then may be discharged to the other side. The anode tube 101 is provided with a slit 121 through which thermal electrons are introduced. That is, the anode tube 101, a type of ionization chamber, is configured to generate positive ions when gas introduced thereinto collides with thermal electrons.

In this instance, a formula representing an ionization process is as follows.

$$M+e^{-}\rightarrow M^{+}+2e^{-}\rightarrow F^{+}+N+2e^{-}$$

Herein, 'M' denotes sample gas for ionization, '$M^{+}$' denotes ionized radical positive ions, '$F^{+}$' denotes fragment ions, 'N' denotes neutral fragment ions, and '$e^{-}$' denotes electrons.

The filament 103 serves to emit thermal electrons for ionizing sample gas introduced into the anode tube 101. The filament 103 may be formed of tungsten, rhenium, etc.

The filament 103 is formed to have a circular arc shape, and is spaced from an outer circumference of the anode tube 101 by a predetermined interval. A first electrode 105 and a second electrode 106 are connected to two ends of the filament 103, and a common electrode 104 is connected to one point of the filament 103 where the first electrode 105 and the second electrode 106 have been connected. An electric current may be selectively supplied to either the common electrode 104 with the first electrode 105, or the common electrode 104 with the second electrode 106. A controller (not shown) for controlling an operation of the ion source is configured to supply the current to one of the first electrode 105 and the second electrode 106, by a preset voltage.

The anode tube 101 receives thermal electrons emitted from the filament 103 through the slit 121. The anode tube 101 may be provided with a plurality of slits 121*a*, 121*b*.

For instance, when the anode tube 101 is provided with two slits 121, the first slit 121*a* may be positioned to face the filament 103 formed between the first electrode 105 and the common electrode 104, and the second slit 121*b* may be positioned to face the filament 103 formed between the second electrode 106 and the common electrode 104.

A repeller 107 (refer to FIG. 2), configured to push thermal electrons emitted from the filament 103 toward the slit 121, is formed at a position spaced from an outer circumference of the filament 103. The repeller 107 may be formed to have a cylindrical shape. Once a voltage higher than a voltage applied to the filament 103 is applied to the anode tube 101, thermal electrons generated from the filament 103 are attracted to the slit 121 of the anode tube 101 by a voltage difference.

A focus lens 109 or an extractor 108 may be positioned below the anode tube 101. The focus lens 109 serves to focus extracted ions and to supply the extracted ions to the filter unit 200 connected thereto. The focus lens 109 may be formed as a lens having a through hole. The extractor 108 is positioned between the focus lens 109 and the anode tube 101, and extracts ions generated from the anode tube 101 to outside of the anode tube 101. The extractor 108 may be formed as a lens having a through hole.

The diffusion-preventing body 130 is formed to reduce an opening ratio of the slit 121. That is, the diffusion-preventing body 130 is configured to reduce discharging rate of the sample gas to outside through the slit 121, and to distribute a voltage inside the anode tube 101 uniformly. For this, the diffusion-preventing body 130 is provided with at least one hole through which thermal electrons pass, so as to reduce diffusion of the thermal electrons.

For instance, the diffusion-preventing body 130 is formed to cover the slit 121. In this instance, an opening ratio of the slit 121 with the diffusion-preventing body 130 may be about 70%.

The diffusion-preventing body 130 may be placed between the filament 103 and the slit 121, or on an inner circumference of the anode tube 101. The diffusion preventing body 130 may be formed of a conductive material. For instance, the diffusion-preventing body 130 may be formed of a stainless steel material. The diffusion-preventing body 130 is provided with at least one hole through which thermal electrons pass. For instance, the diffusion-preventing body 130 may be formed as a metallic mesh with a plurality of holes. The diffusion-preventing body 130 reduces diffusion of electron beams, including thermal electrons, into the periphery inside the anode tube 101. The diffusion-preventing body 130 may be coupled to the anode tube 101 so as to cover the slit 121 of the anode tube 101.

Figure 6:
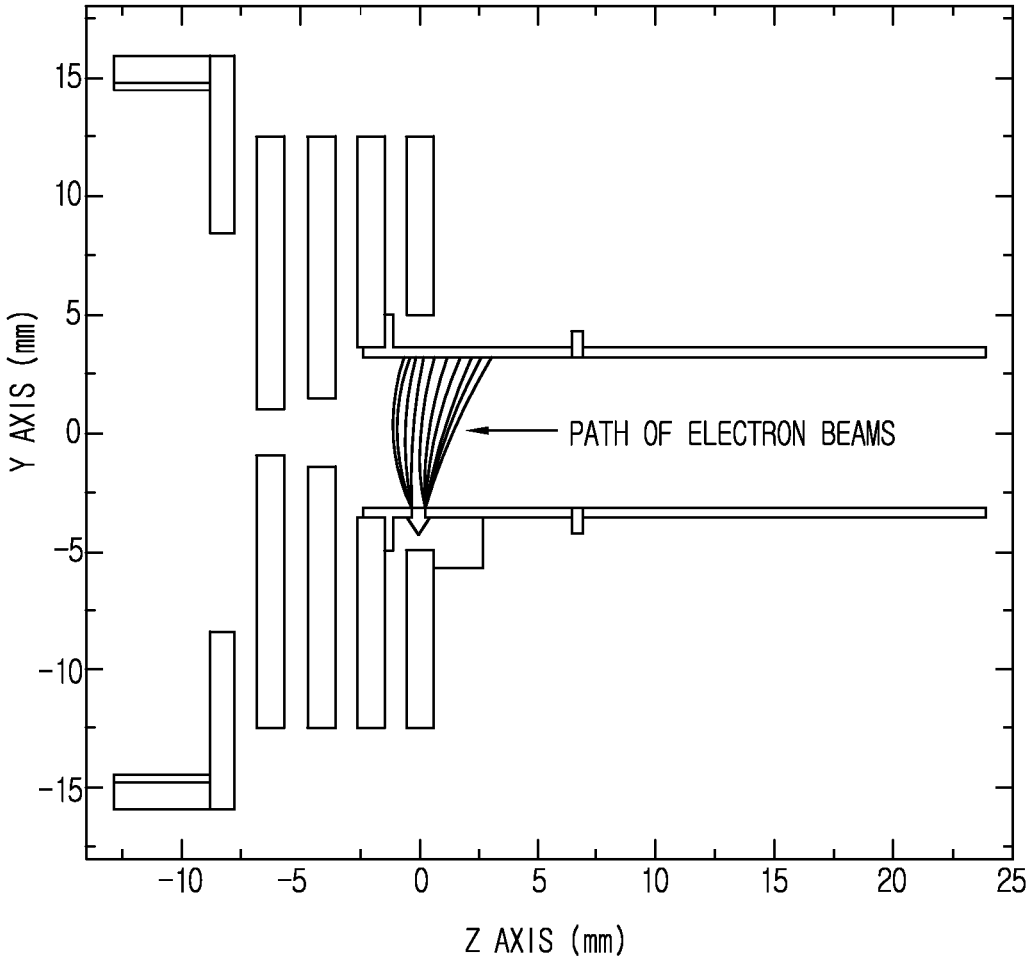
FIG. 6 is a conceptual view illustrating a moving path of thermal electrons of FIG. 5 according to a comparative embodiment.
Figure 7:
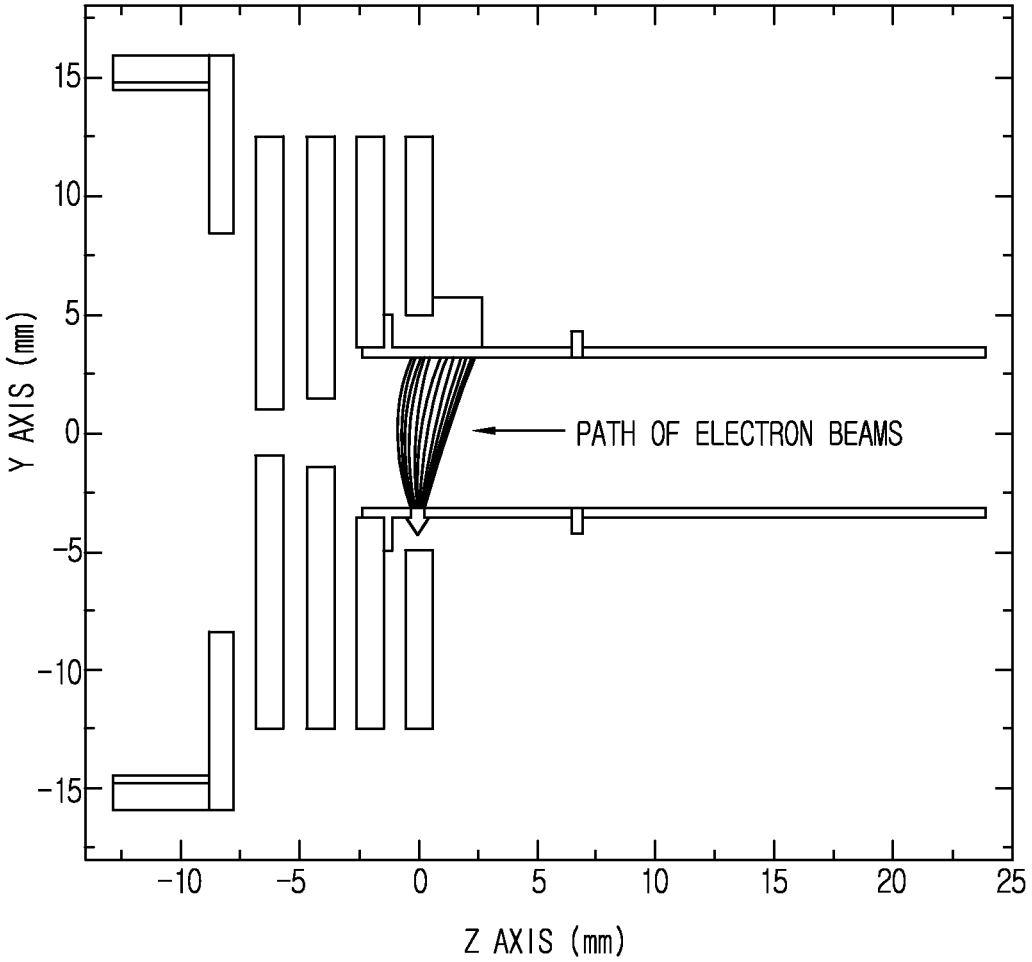
FIG. 7 is a conceptual view illustrating a moving path of thermal electrons of FIG. 5 according to a preferred embodiment.

Hereinafter, the present invention will be explained in more detail with reference to FIGS. 6 and 7. FIG. 6 is a conceptual view illustrating a moving path of thermal electrons of FIG. 5 according to a comparative embodiment. FIG. 7 is a conceptual view illustrating a moving path of thermal electrons of FIG. 5 according to a preferred embodiment.

FIG. 6 illustrates a path (trajectory) of electron beams at the ion source 100 without the diffusion-preventing body 130 according to a comparative embodiment, and FIG. 7 illustrates a path of electron beams at the ion source 100 provided with the diffusion-preventing body 130 according to a preferred embodiment of the present invention.

As shown in FIGS. 6 and 7, a path of electron beams is less diffused in the preferred embodiment, than in the comparative embodiment. In case of the ion source having two slits according to a comparative embodiment, a voltage inside the anode tube is distributed non-uniformly due to the slits, and a voltage deviation is increased according to a position inside the anode tube. Due to such a non-uniform voltage distribution, thermal electrons introduced into the anode tube are diffused. Further, since gas flowing in the anode tube is discharged out quickly through the slits, ionization efficiency of the introduced gas is reduced.

The diffusion-preventing body 130 (refer to FIG. 4) is configured to uniformly distribute voltage inside the anode tube by including at least one hole, thereby preventing diffusion of thermal electrons as shown in FIG. 7. Further, the diffusion-preventing body 130 prevents diffusion of electrons passing therethrough, and reduces gas flowing out through the slit 121, by reducing an opening ratio of the slit 121. Further, the diffusion-preventing body 130 is formed of a conductive material, thereby reducing occurrence of a voltage difference at the two sides of the slit 121.

Figure 8:
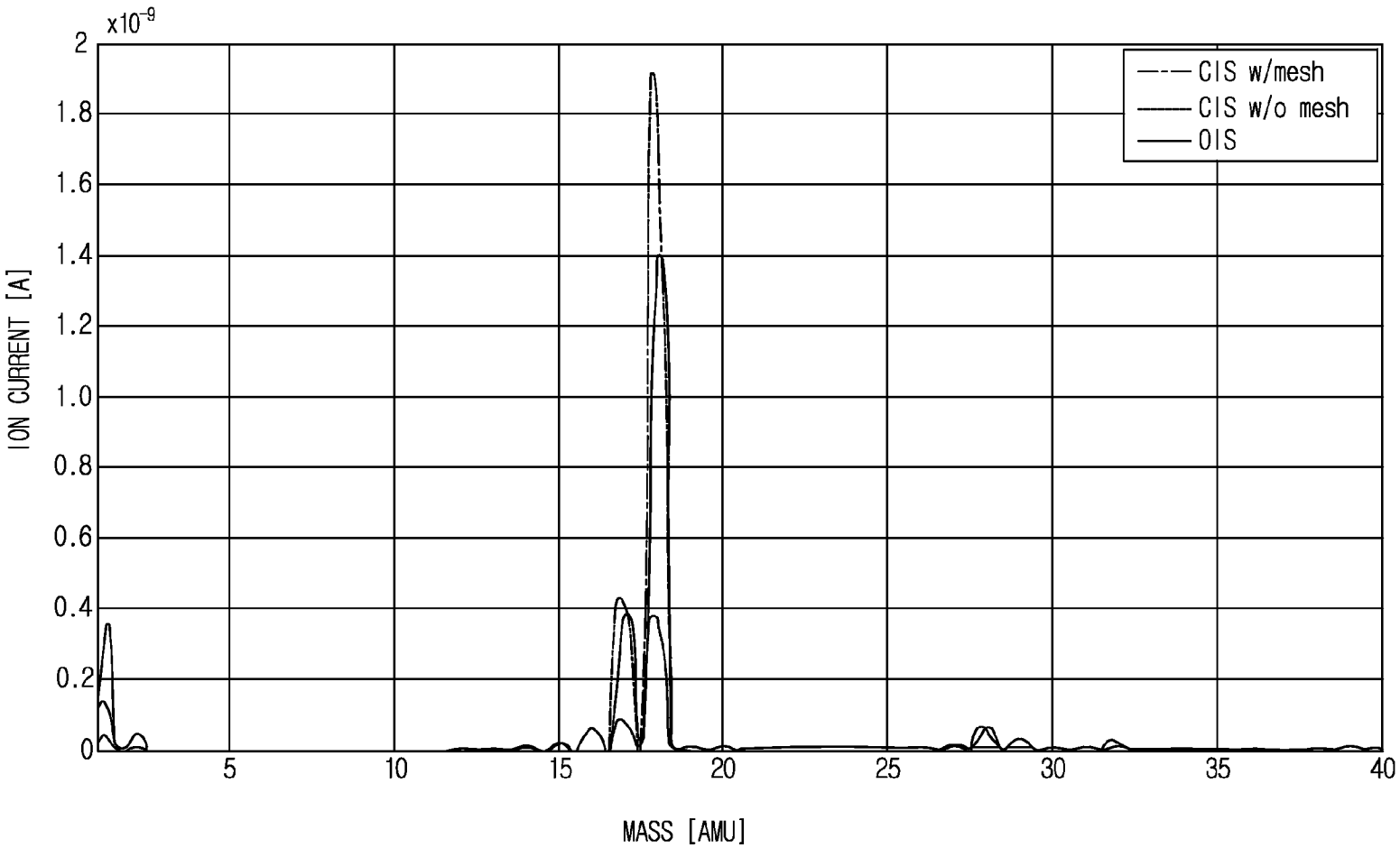
FIG. 8 is a view illustrating sensitivity of a mass spectrometer in case of measuring residual gas according to a preferred embodiment of the present invention.
Figure 9:
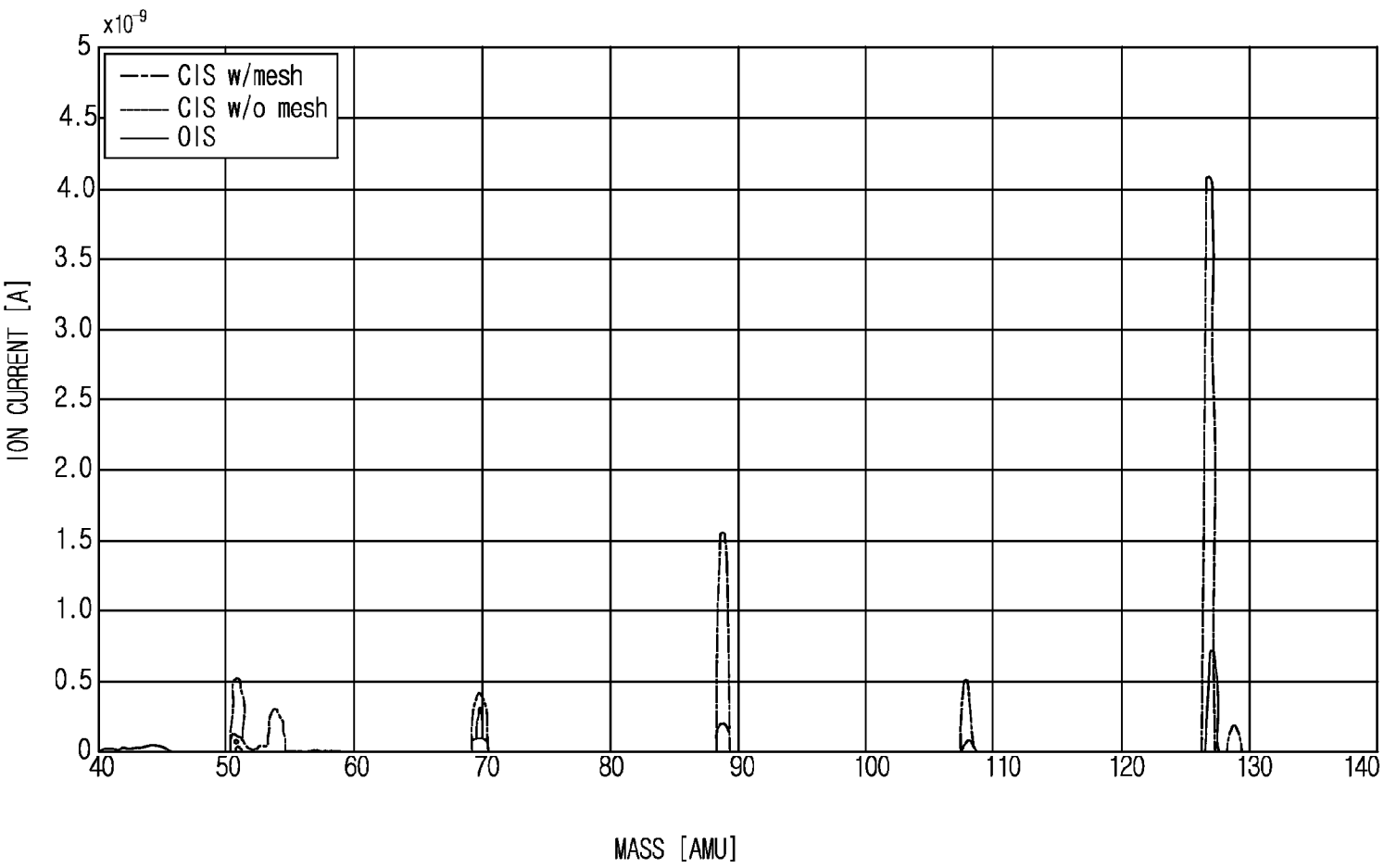
FIG. 9 is a view illustrating sensitivity of a mass spectrometer in case of measuring $SF_6$ gas according to a preferred embodiment of the present invention.

FIG. 8 is a view illustrating sensitivity of a mass spectrometer in case of measuring residual gas according to a preferred embodiment of the present invention, and FIG. 9 is a view illustrating sensitivity of the mass spectrometer in case of measuring $SF_6$ gas according to a preferred embodiment of the present invention.

When a vacuum level (degree of vacuum) is $2\times10^{-6}$ Torr after vacuum pumping has started, by opening a needle valve, the vacuum level is adjusted to $5\times10^{-6}$ Torr. Under such a configuration, signal intensities are compared to each other in a condition that the same amount of $SF_6$ gas is injected at each experiment. FIG. 8 illustrates a signal intensity comparison result when residual gas is measured at a mass range of 1-40 amu, and FIG. 9 illustrates a signal intensity comparison result when $SF_6$ gas is measured at a mass range of 40-130 amu.

A red spectrum was obtained using a CIS with the diffusion-preventing body 130, a blue spectrum using a general CIS without the diffusion-preventing body, and a black spectrum using an OIS. FIG. 8 shows that a CIS with the diffusion-preventing body 130 provides about 4-5 times enhanced signal intensity than that the general CIS. When the CIS is compared with the OIS, the overall signal intensities are almost the same, although each mass peak shows a little different intensity. However, in a condition that $SF_6$ sample gas is injected from outside (FIG. 9), the CIS with the diffusion-preventing body 130 provides about 10 times enhanced signal intensity than a general CIS without the diffusion-preventing body and an OIS.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. An ion source, comprising:

an anode tube including a slit formed on a lateral portion thereof and configured to ionize gas introduced thereinto through one side and to discharge the ionized gas to the other side;

a filament configured to emit thermal electrons toward the slit so as to ionize the gas; and a diffusion-preventing body having a plurality of holes and coupled to the anode tube through which the thermal electrons pass so as to reduce diffusion of the thermal electrons flowing into the anode tube;

wherein the slit is formed to penetrate through an outer circumference and an inner circumference of the anode tube; and wherein the diffusion-preventing body is coupled to an inner circumference or an outer circumference of the anode tube to cover the formed slit.

2. The ion source of claim 1, wherein the diffusion-preventing body is formed of a conductive material and is formed to have a mesh shape.

3. The ion source of claim 1, wherein the filament is spaced from the slit so as to maintain a distance from the slit, and is connected to a first electrode and a second electrode, and wherein the filament is connected to a common electrode on one point between the first and second electrodes.

4. The ion source of claim 3, wherein the slit is positioned to face the filament formed between the first electrode and the common electrode, or the slit is positioned to face the filament formed between the second electrode and the common electrode.

5. The ion source of claim 1, wherein the slit is formed on an outer circumference of the anode tube in plurality in number.

6. The ion source of claim 3, wherein an electric current is selectively applicable to the first electrode or the second electrode.

7. A mass spectrometer, comprising:

the ion source of claim 1 configured to ionize gas introduced thereinto through one side and to discharge the ionized gas to the other side;

a mass filter unit configured to filter ions discharged from the ion source on the basis of a mass; and a detector configured to detect the filtered ions.

* * * * *